US006031331A

United States Patent [19]

Kohlmann et al.

[11] Patent Number: 6,031,331

[45] Date of Patent: Feb. 29, 2000

[54] ELECTRIC LAMP HAVING LAMP VESSEL WITH IMPROVED PINCH SEAL

[75] Inventors: Wilfried L. Kohlmann, Aldenhoven; Ludwig J. Böndgen, Stolberg, both of Germany

[73] Assignee: U.S. Phillips Corporation, New York, N.Y.

[21] Appl. No.: 09/162,837

[22] Filed: Sep. 29, 1998

[30] Foreign Application Priority Data

Oct. 2, 1997 [EP] European Pat. Off. ..... 97203031

[51] Int. Cl.[7] ..... H01J 17/18

[52] U.S. Cl. ..... 313/623; 313/315

[58] Field of Search ..... 313/623, 315, 313/316; 225/2; 445/27

[56] References Cited

U.S. PATENT DOCUMENTS 5,025,192 6/1991 Okamoto ..... 313/623

5,286,227 2/1994 Numajiri et al. ..... 445/26

FOREIGN PATENT DOCUMENTS 170801 3/1952 Austria .

41253 8/1937 Netherlands .

WO9634405 10/1996 WIPO ..... H01J 61/36

*Primary Examiner*—Micahel H. Day
*Assistant Examiner*—Todd Reed Hopper
*Attorney, Agent, or Firm*—F. Brice Faller

[57] ABSTRACT

The electric lamp has a quartz glass lamp vessel (1) having first and second neck-shaped portions (2, 3) with first and second seals (4, 5). Current supply conductors (6, 7, 8; 9, 10, 11) consist of a metal foil (7, 10) embedded in the respective seal (4, 5), an inner (6, 9) and an outer current wire (8, 11) connected hereto. A seal ends with a closed fracture surface (14) through which an outer current wire (8, 11) extends. Favorably, the edge (13) of the fracture surface (14) has some small indentations (16) adjacent the origin of the fracture (19). The total length of the lamp is about 2 mm less than that of its conventional counterpart.

6 Claims, 3 Drawing Sheets

ELECTRIC LAMP HAVING LAMP VESSEL WITH IMPROVED PINCH SEAL

The invention relates to an electric lamp comprising:

a quartz glass lamp vessel which is sealed in a gastight manner and which is provided with a neck-shaped portion comprising a seal having a longitudinal axis extending from a first to a second end portion, a current supply conductor being passed through said seal to an electric element arranged in the lamp vessel;

which current supply conductor comprises a metal foil, an inner lead wire, and an outer lead wire, said metal foil being embedded in the seal in a gastight manner, while the inner lead wire connected to the electric element is connected to the metal foil in the first end portion and the outer lead wire is connected to the metal foil in the second end portion.

Such an electric lamp is known from WO 96/34405. The lamp may be used for accent lighting, for example in shop windows, but it may also be used in other, for example optical applications. The lamp may be placed in a reflector for these applications. It is important here for the lamp in combination with the reflector to supply a light beam with the smallest possible scattering and disturbance of the radiated light. The reflector may have a front glass with which the lamp is not allowed to be in permanent contact. It should also be avoided that lamp components which may be present in the path of the light throw an undesirable shadow image on the front glass of the reflector. It is important for this reason that on the one hand the lamp should be as far removed from the front glass as is possible, while on the other hand the aim is to make the reflector as small as possible, which requires the lamp to be placed as close as possible to the front glass.

Quartz glass is a glass having an $SiO_2$ content of more than 95% by weight. The seal of the lamp may have the shape, for example, of a pinch or, for example, a fusion seal, and is achieved through embedding of the metal foil, for example made of molybdenum, in the quartz glass. The gas-tightness of the seal is achieved in that the metal foil, which has knife edges, adheres at least substantially at all sides to the quartz. Portions of the inner and outer leads, which are made, for example, of tungsten or molybdenum, will also become embedded during this process of embedding of the metal foil. Capillaries will usually be formed around these lead wires upon cooling down.

During the manufacture of the known lamp, for example while the seal is being made, it may be necessary to protect the electric element, the metal foil, and the inner and outer leads, together forming the metal elements, from oxidation. To achieve this, a prolonged portion in the form of a glass tube is present at the side of the outer lead wire, serving as an exhaust tube, so that the metal elements can be kept in a conditioned atmosphere during the manufacture of, for example, the seal. The seal of the known lamp consists of a portion of the glass tube which was shaped into a solid mass by means of heating and softening, whereby the embedding of the metal foil and the lead wires has been realized. The prolonged portion of the glass tube is given a saw cut at some distance from the solid portion of the quartz glass forming the seal after the quartz glass has cooled down and solidified. The saw cut acts as a location for breaking off the prolonged portion. A fracture will arise upon breaking-off, so that a glass tube remnant is separated. The glass tube remnant thus separated can be removed, for example, by pulling it away over the outer lead wire. The known lamp has thus been given its final shape, with the disadvantage that it has a remaining portion of glass tubing at the second end portion which extends away from the seal with a widening cup shape and which has an open, annular fracture surface which forms the boundary of the widening cup shape. It is also disadvantageous that the lamp is longer than appears to be necessary for a satisfactory operation of the lamp owing to the above manufacturing method, because the fracture surface is formed at some distance from the seal.

The width of the saw cut causes a spread to arise as to the location of the point of application for the severing fracture, so that easily variations in length of, for example, 1 mm can occur among lamps. This is a further disadvantage, in particular for the reproducible manufacture of the lamp on an industrial scale. In addition, lamp components may interfere with the light beam owing to the additional length of the lamp caused by the application of the saw cut at some distance from the seal, throwing an undesirable shadow contour on the front glass of the reflector, or even being in contact permanently with the front glass. This can indeed be counteracted in that, for example, a larger reflector is chosen, but this conflicts with the desire for a reflector which is as small as possible. Furthermore, making of the sawcut generates quartz glass dust, which may lead to pollution of the lamp and the production system. This is a further disadvantage.

SUMMARY OF THE INVENTION

According to the invention, the second end portion has an end with an at least substantially closed fracture surface, the outer lead wire issuing to the exterior through said substantially closed fracture surface.

A shortening of the lamp is realized by breaking off the prolonged portion of the glass tube at the area of the solid portion of the seal. This shortening has the advantage that the possibilities of using smaller reflectors are strongly increased. The shortening is achieved by damaging the solid portion of the quartz glass in the seal at the area of the outer lead wire, for example by incising with one or several cutters. The damage caused thereby forms a fracture origin for a fracture having a closed fracture surface which will be formed when the prolonged portion of the glass tube is broken off. The removal of the prolonged portion of the glass tube in this manner ensures that the electric lamp according to the invention can be manufactured free from quartz glass dust and in a reproducible manner. The manufacturing process of the known lamp can be substantially followed in other respects in order to create a lamp according to the invention. The at least substantially closed shape of the fracture surface from which the outer lead wire issues to the exterior renders possible the presence of a capillary around the outer lead wire issuing to the exterior. The end has a cross-section which is substantially identical to a cross-section of the seal. This has the advantage that the lamp is safer, because the end will hook itself less readily behind objects, and the end will less quickly be touched during mounting of the lamp at least in that area. A resulting smaller risk of damage to other objects or, for example, injuries to persons renders it unnecessary to make the outer edge of the end blunt. This is in contrast to the known lamp, which has a remaining portion of glass tubing at the second end portion which extends away from the seal with a widening cup shape and which has an annular fracture surface around this annular cup shape at its end.

The desire for a lamp which is as short as possible renders it advantageous to make the severing fracture as close to the metal foil as possible. This, however, increases the risk of the metal foil intersecting the fracture surface owing to a possible strongly oblique position of the fracture surface. The shape of the fracture surface and the direction in which this fracture surface extends are determined to a high degree by the forces exerted for the purpose of fracturing. If a pulling force substantially parallel to the longitudinal axis is exerted during fracturing in addition to a small bending force, a fracture surface will in general be obtained which is substantially planar and which extends in a direction substantially perpendicular the pulling direction, and thus perpendicular to the longitudinal axis. In a favorable embodiment of a lamp according to the invention, the closed fracture surface is substantially planar extends in a direction substantially perpendicular to the longitudinal axis. This embodiment has the advantage inter alia that undesirable reflections or light refraction will occur to a lesser degree than at a fracture surface having several facets with mutually strongly differing orientations. In addition, the closed, substantially plane fracture surface from which the outer lead wire issues to the exterior gives the lamp a neatly finished appearance. A second advantage is that the risk of the metal foil intersecting the fracture surface is very strongly reduced because the fracture surface extends in a direction substantially perpendicular to the longitudinal axis. Moreover, a spread in length among individual lamps will be smaller than among individual lamps whose fracture surfaces are not substantially plane or do not extend in a direction substantially transverse to the longitudinal axis.

It is favorable to form the lamp during the cooling-down phase from the moment the seal is made, for example by means of a sealing process, in contrast to the process for the known lamp. Preferably, this forming operation comprises an incising operation by means of one or several cutters into the solid but still partly soft portion of the quartz glass at the area of the outer lead wire in the seal. The quartz glass is purposely formed in that case by means of the incision. The degree of forming of the second end of the seal depends on the degree to which the quartz glass is still soft during cooling-down. In the case of a comparatively strong cooling-down and a low degree of softness of the quartz glass, the forming will be small and hardly observable, or even absent. The forming will be very strong, however, if the quartz glass has cooled down comparatively little and is accordingly still very soft. The mechanical strength of the quartz glass in a direction substantially perpendicular to the longitudinal axis is reduced by the forming in the solid portion of the seal. The prolonged portion of the glass tube can accordingly be readily broken off in an accurately defined location at the area of the forming. This leads to a further reduction in the spread in length among individual lamps.

A fracture has a fracture origin and the fracture surface arising from the fracture has a fracture pattern. The fracture origin can be ascertained from the fracture pattern of the fracture surface. A further favorable embodiment is a lamp according to the invention wherein a damage in the shape of, for example, a microcrack is present at the area of the forming, remaining behind subsequently in the form of an indentation of the outer edge of the fracture surface. The presence of the microcrack is advantageous because it facilitates the subsequent severing of the prolonged portion of the glass tube and defines the location of the fracture with high accuracy. It can be ascertained from the fracture pattern that the microcrack forms the fracture origin of the fracture. To achieve that the microcrack will act as the fracture origin, it is essential for the quartz glass to be somewhat cooled down during the incising process, but to be still capable of forming so as to achieve an accurate position of the permanent microcrack. The quartz glass, however, must not be so soft that the microcrack has disappeared owing to flow processes during subsequent cooling down. The position of the microcrack, and accordingly of the fracture, is more accurately determined and much more localized by means of forming than by means of, for example, a saw cut. The spread in the lamp shape, for example the length, is smaller as a result. It is thus advantageously achieved that the variation in length among lamps is yet further reduced.

It is noted that it is known from NL-A-0 041 253 that the subsequent separation of an exhaust tube of an incandescent lamp can be prepared this tube by pinching together in its still softened portion during tipping, or during cooling-down after tipping of the exhaust tube. The exhaust tube is later broken off at the area of the pinched portion. This, however, relates to a glass operation for the manufacture of incandescent lamps, where no outer lead wire extends through the exhaust tube. Glass suitable for the manufacture of incandescent lamps is not quartz glass, having an $SiO_2$ content well below 90% by weight, and is much easier to process than is quartz glass. Processing of the quartz glass is yet further complicated by the presence of an outer lead wire during the manufacture of a lamp according to the invention.

The lamp according to the invention may have a filling. The electric element may be an incandescent body, in which case the filling may comprise a halogen. The element may alternatively be a pair of electrodes. In that case the lamp will have an ionizable filling, a filling comprising rare gas, such as, for example, xenon, at a pressure of a few, for example 7 bar in the non-operational state, and one or several metal halides, possibly with mercury added.

The lamp vessel may be accommodated, for example permanently, in a reflector which may be closed off, for example with a front glass in the form of, for example, a glass plate or a lens. The lamp vessel may be coated with a dichroic filter. The lamp vessel may alternatively have an outer envelope, for example made of quartz glass, which may be joined to the lamp vessel, for example to the neck-shaped portions thereof, for example through fusion thereto. The envelope may be, for example, UV-absorbing.

DETAILED DESCRIPTION OF THE PREFERRED EMBODIMENT

Figure 1:
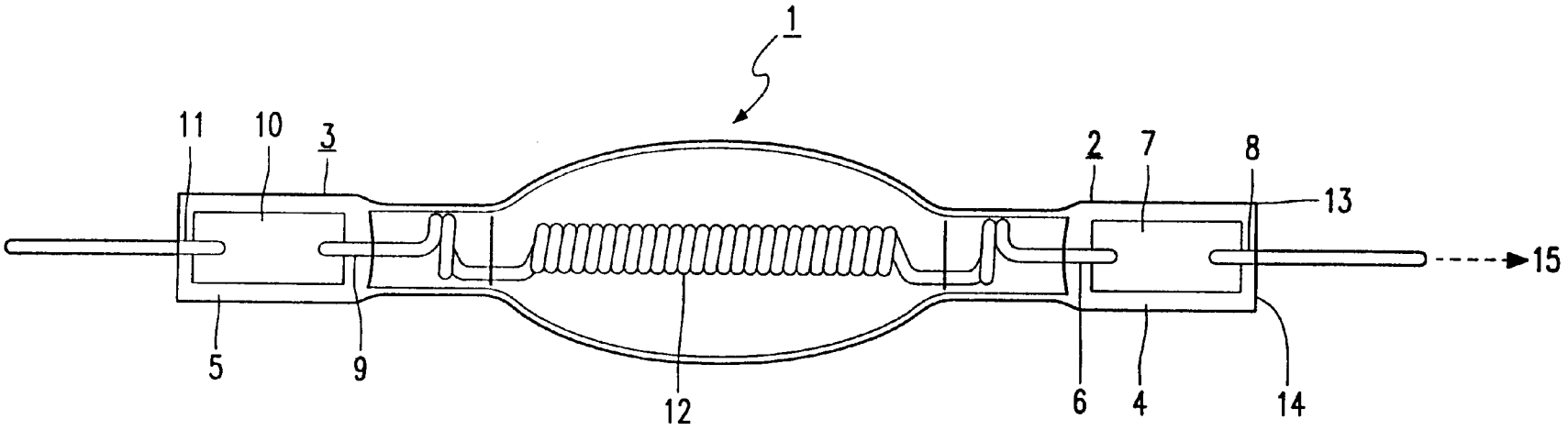
FIG. 1 shows the lamp in side elevation.

The electric lamp of FIG. 1 has a quartz glass lamp vessel 1 of fused $SiO_2$ which is sealed in a gastight manner and which has mutually opposed first and second neck-shaped portions 2 and 3 with respective seals 4 and 5 through which respective current conductors 6, 7, 8; 9, 10, 11 extend to an electric element 12 accommodated in the lamp vessel. The electric element 12 in the Figure is an incandescent wire. The current supply conductors 6, 7, 8; 9, 10, 11 each comprise a metal foil 7, 10 which is embedded in a gastight manner in the respective seal 4, 5 and to which a respective inner lead wire 6, 9 is connected in a first end portion of the seal 4, 5 so as to extend to the electric element 12, and to which a respective outer lead wire 8, 11 is connected in a second end portion of the seal 4, 5 so as to issue from the relevant seal 4, 5 to the exterior. The seal 4 has been somewhat formed at its second end portion. As a result of this, the outer edge 13 of the fracture surface 14 lies locally closer to the longitudinal axis 15. It is alternatively possible for the lamp to have only one seal with the current conductors 6, 7, 8; 9, 10, 11 therein.

Figure 2:
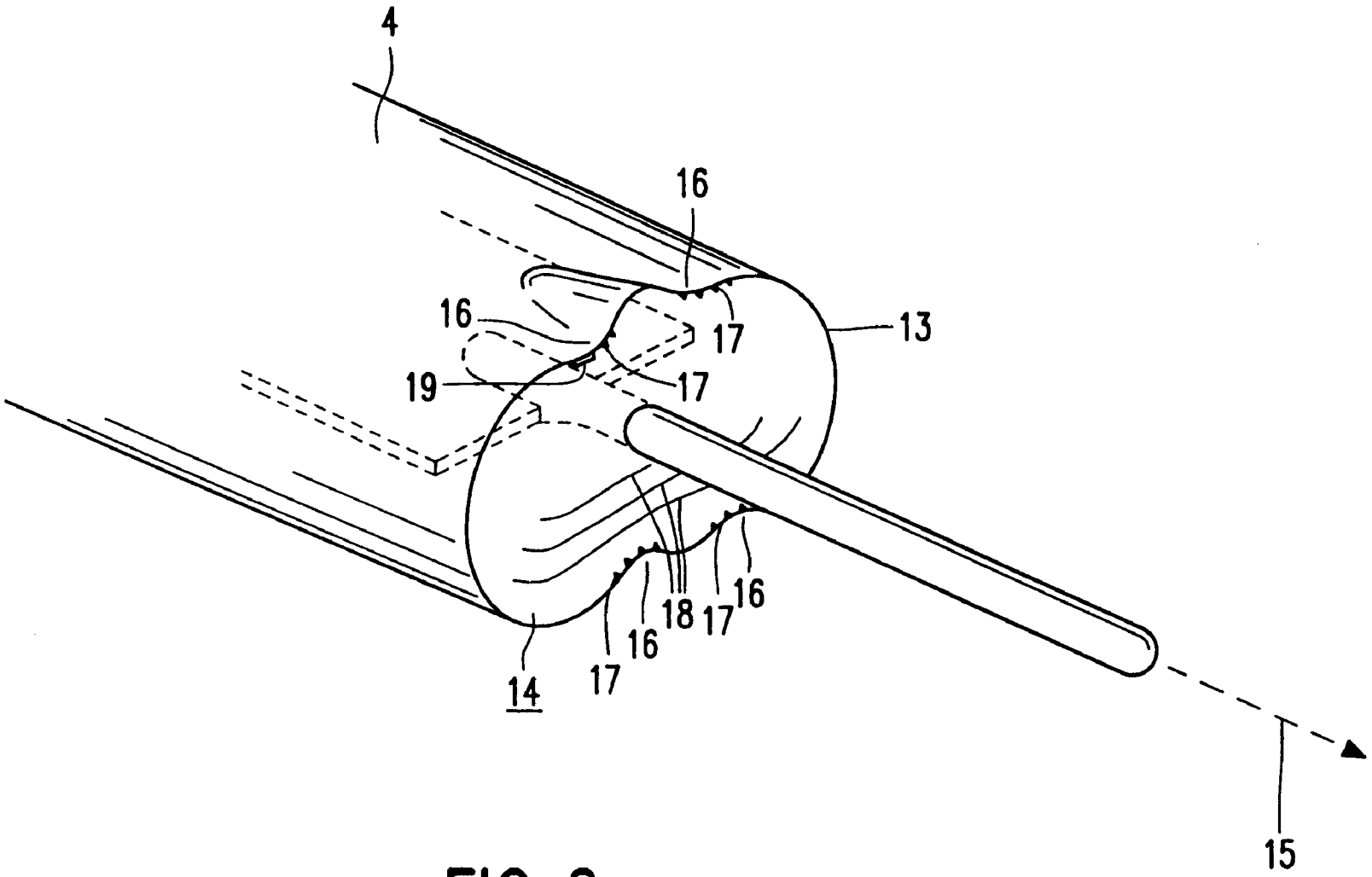
FIG. 2 shows a detail of the second end of the seal of the lamp of FIG. 1 in perspective view.

FIG. 2 shows a detail of the second end portion of the seal 4 of the lamp of FIG. 1 in perspective view. The second end portion has been somewhat formed and is bounded by a fracture surface 14 which extends in a direction substantially perpendicular to the longitudinal axis 15. The outer edge 13 of the fracture surface 14 has four indentations 16 and minor damage points 17 adjacent thereto. Such a damage point 17 may be provided, for example at one side or at both sides, for example by means of a single cutter which may be made, for example, from a ceramic material or metal. A fracture pattern 18 is discernible on the fracture surface 14, indicating a fracture origin 19 adjacent the indentations 16.

Figure 3:
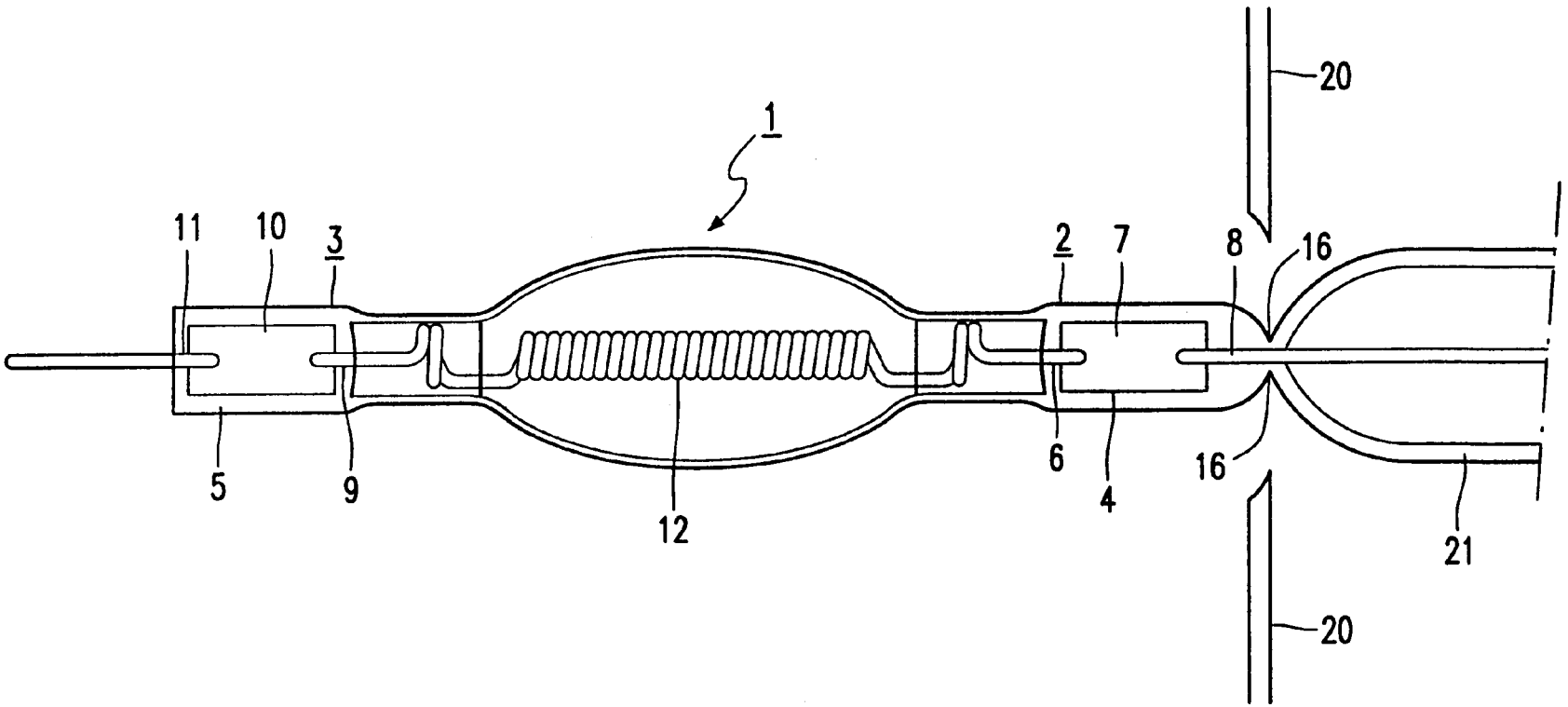
FIG. 3 shows the lamp in side elevation during a stage in its manufacture.

FIG. 3 shows the lamp of FIG. 1 during the forming stage. The indentations 16 are made by means of incisions with cutters 20 into the second end portion of the seal 4. Breaking-off of the prolonged portion of the glass tube 21 at the area of the indentations 16 is considerably facilitated thereby and accurately localized.

The lamp shown is obtained in that an electric element 12 is placed in the lamp vessel 1, i.e. an incandescent wire in the lamp shown, with respective current conductors 6, 7, 8; 9, 10, 11 connected thereo. After a first seal 5 has been made, the second seal 4 is made, so that the lamp vessel 1 is closed in a gastight manner. While the seals 4, 5 are being made, a conditioned, non-oxidizing atmosphere is maintained adjacent the metal elements of the lamp, for example nitrogen or argon. The seals 4, 5 may be, for example, pinch seals or fusion seals. During cooling-down of the quartz glass after the second seal 4 has been made, a damage point 17 has been purposely provided in the seal 4 at the area of the outer lead wire 8, but not at the level of the metal foil 7. Four indentations 16 and damage points 17 were provided in the lamp shown by means of pinching and incising with cutters 20. The lamp shown was obtained in that the quartz glass was broken off at the area of the purposely provided damage points 17 after cooling-down, i.e. when the quartz glass had solidified. The prolonged portion of the glass tube 21 is pulled away over the outer lead wire 8 after the severing operation at the area of the indentation 16, and the lamp is obtained in its final shape. Measurements have shown that the lamp as shown is on average 2 mm shorter than the comparable known lamp.

We claim:

1. An lamp comprising:

a quartz glass lamp vessel (1) which is sealed in a gastight manner and which is provided with a neck-shaped portion (2, 3) comprising a seal (4, 5) having a longitudinal axis (15) extending from a first end portion of said seal to a second end portion of said seal, a current supply conductor passing through said seal to an electric element (12) arranged in the lamp vessel;

which current supply conductor comprises a metal foil (7, 10), an inner lead wire (6, 9), and an outer lead wire (8, 11), said metal foil being embedded in the seal in a gastight manner, while the inner lead wire connected to the electric element is connected to the metal foil in the first end portion and the outer lead wire is connected to the metal foil in the second end portion, characterized in that the second end portion has an end with an at least substantially closed fracture surface (14) transverse to the longitudinal axis, the outer lead wire issuing to the exterior through said substantially closed fracture surface.

2. An electric lamp as claimed in claim 1 where the fracture surface (14) is substantially planar and extends in a direction substantially perpendicular to the longitudinal axis (15).

3. An electric lamp as claimed in claim 1 characterized in that the second end portion has a formed shape, and the fracture surface (14) has an outer edge (13) with at least one indentation (16).

4. An electric lamp as claimed in claim 3, characterized in that the fracture surface (14) has a fracture origin (19) which is situated at the area of the indentation (16).

5. Method of manufacturing an electric lamp, said method comprising providing a quartz glass lamp vessel having opposed first and second end portions having a longitudinal axis therethrough, forming seals about first and second conductors in respective said first and second end portions while said quartz glass lamp vessel is soft, forming damage points on opposite sides of said longitudinal axis at said second end portion while said lamp vessel is soft, and breaking off said lamp vessel at said damage points when said lamp vessel has solidified.

6. Method as in claim 5 further comprising pinching said second end portion to provide indentations while said lamp vessel is soft, said damage points being formed in said indentations.

* * * * *